US009263060B2

(12) United States Patent
Sharp

(10) Patent No.: US 9,263,060 B2
(45) Date of Patent: Feb. 16, 2016

(54) ARTIFICIAL NEURAL NETWORK BASED SYSTEM FOR CLASSIFICATION OF THE EMOTIONAL CONTENT OF DIGITAL MUSIC

(75) Inventor: David A. Sharp, Fairfax, VA (US)

(73) Assignee: MARIAN MASON PUBLISHING COMPANY, LLC, McLean, VA (US)

( * ) Notice: Subject to any disclaimer, the term of this patent is extended or adjusted under 35 U.S.C. 154(b) by 629 days.

(21) Appl. No.: 13/590,680

(22) Filed: Aug. 21, 2012

(65) Prior Publication Data

US 2014/0058735 A1 Feb. 27, 2014

(51) Int. Cl.

*G10L 25/63* (2013.01)
*G10H 1/00* (2006.01)
*G10L 25/30* (2013.01)

(52) U.S. Cl.

CPC ..... *G10L 25/63* (2013.01); *G10H 1/0008* (2013.01); *G10H 2210/066* (2013.01); *G10H 2240/085* (2013.01); *G10H 2240/131* (2013.01); *G10H 2250/311* (2013.01); *G10L 25/30* (2013.01)

(58) Field of Classification Search

CPC ..... G10H 2240/085
USPC ..... 704/500, 207; 700/94
See application file for complete search history.

(56) References Cited

U.S. PATENT DOCUMENTS 4,023,456 A 5/1977 Groeschel
4,350,070 A 9/1982 Bahu
4,375,058 A 2/1983 Bouma
4,377,961 A 3/1983 Bode
4,479,416 A 10/1984 Clague
5,343,251 A 8/1994 Nafeh
5,371,854 A 12/1994 Kramer
5,406,024 A 4/1995 Shioda
5,631,883 A 5/1997 Li
5,918,223 A 6/1999 Blum
5,945,986 A 8/1999 Bargar
5,957,697 A 9/1999 Iggulden
5,986,199 A 11/1999 Peevers
6,156,964 A 12/2000 Sahai
6,332,137 B1 12/2001 Hori
6,355,869 B1 3/2002 Mitton
6,385,581 B1 5/2002 Stephenson (Continued)

FOREIGN PATENT DOCUMENTS

EP 1304628 A2 4/2003
EP 1260968 B1 3/2005

(Continued)

OTHER PUBLICATIONS

Fu, Zhouyu, et al. "A survey of audio-based music classification and annotation." Multimedia, IEEE Transactions on 13.2 (2011): 303-319.*

(Continued)

*Primary Examiner* — Lamont Spooner
(74) *Attorney, Agent, or Firm* — Walter M. Egbert, II; Foley Hoag LLP

(57) ABSTRACT

A system for classification of the emotional content of music is provided. An encoder receives a digital audio recording of a piece of music, and encodes it using musical notes and associated amplitudes. The artificial neural network is configured to take a plurality of encoded time slices and provide output indicative of the emotional content of the music.

15 Claims, 4 Drawing Sheets

(56) References Cited

U.S. PATENT DOCUMENTS

| | | | | |
|---|---|---|---|---|
| 6,423,893 | B1 | 7/2002 | Sung | |
| 6,424,944 | B1 | 7/2002 | Hikawa | |
| 6,441,291 | B2 | 8/2002 | Hasegawa | |
| 6,476,308 | B1 * | 11/2002 | Zhang | 84/616 |
| 6,539,395 | B1 | 3/2003 | Gjerdingen | |
| 6,574,441 | B2 | 6/2003 | McElroy | |
| 6,700,048 | B1 | 3/2004 | Terada | |
| 6,832,194 | B1 | 12/2004 | Mozer | |
| 6,964,023 | B2 | 11/2005 | Maes | |
| 7,075,000 | B2 | 7/2006 | Gang | |
| 7,082,394 | B2 | 7/2006 | Burges | |
| 7,102,067 | B2 | 9/2006 | Gang | |
| 7,103,548 | B2 | 9/2006 | Squibbs | |
| 7,185,201 | B2 | 2/2007 | Rhoads | |
| 7,295,977 | B2 | 11/2007 | Whitman | |
| 7,302,574 | B2 | 11/2007 | Conwell | |
| 7,328,272 | B2 | 2/2008 | Kuramochi | |
| 7,365,260 | B2 | 4/2008 | Kawashima | |
| 7,415,407 | B2 | 8/2008 | Naruse | |
| 7,424,682 | B1 | 9/2008 | Pupius | |
| 7,427,018 | B2 | 9/2008 | Berkun | |
| 7,457,749 | B2 | 11/2008 | Burges | |
| 7,587,681 | B2 | 9/2009 | Kake | |
| 7,599,838 | B2 | 10/2009 | Gong | |
| 7,629,528 | B2 | 12/2009 | Childs, Jr. | |
| 7,689,422 | B2 | 3/2010 | Eves | |
| 7,783,249 | B2 | 8/2010 | Robinson | |
| 7,790,974 | B2 | 9/2010 | Sherwani | |
| 7,842,874 | B2 | 11/2010 | Jehan | |
| 7,858,867 | B2 | 12/2010 | Sherwani | |
| 7,982,117 | B2 | 7/2011 | Alcalde | |
| 8,008,566 | B2 | 8/2011 | Walker, II | |
| 8,037,006 | B2 | 10/2011 | Yen | |
| 8,053,659 | B2 | 11/2011 | Alcalde | |
| 8,170,702 | B2 * | 5/2012 | Kemp et al. | 700/94 |
| 2001/0022127 | A1 | 9/2001 | Chiurazzi | |
| 2001/0044719 | A1 | 11/2001 | Casey | |
| 2002/0002899 | A1 | 1/2002 | Gjerdingen | |
| 2002/0133499 | A1 | 9/2002 | Ward | |
| 2002/0147782 | A1 | 10/2002 | Dimitrova | |
| 2003/0078919 | A1 | 4/2003 | Suzuki | |
| 2003/0191764 | A1 | 10/2003 | Richards | |
| 2003/0236663 | A1 | 12/2003 | Dimitrova | |
| 2004/0122663 | A1 | 6/2004 | Ahn | |
| 2004/0231498 | A1 * | 11/2004 | Li et al. | 84/634 |
| 2005/0228649 | A1 | 10/2005 | Harb | |
| 2005/0238238 | A1 | 10/2005 | Xu | |
| 2006/0065102 | A1 | 3/2006 | Xu | |
| 2006/0095254 | A1 * | 5/2006 | Walker et al. | 704/207 |
| 2006/0122834 | A1 * | 6/2006 | Bennett | 704/256 |
| 2006/0155399 | A1 | 7/2006 | Ward | |
| 2007/0113248 | A1 | 5/2007 | Hwang | |
| 2008/0082323 | A1 | 4/2008 | Bai | |
| 2008/0133556 | A1 | 6/2008 | Conwell | |
| 2008/0188967 | A1 * | 8/2008 | Taub et al. | 700/94 |
| 2008/0215599 | A1 | 9/2008 | Yun | |
| 2009/0069914 | A1 * | 3/2009 | Kemp et al. | 700/94 |
| 2009/0132593 | A1 | 5/2009 | Lv | |
| 2009/0281906 | A1 | 11/2009 | Cai | |
| 2009/0282966 | A1 * | 11/2009 | Walker et al. | 84/616 |
| 2010/0027820 | A1 | 2/2010 | Kates | |
| 2011/0022615 | A1 | 1/2011 | Yang | |
| 2011/0112994 | A1 | 5/2011 | Goto | |

FOREIGN PATENT DOCUMENTS

| | | | |
|---|---|---|---|
| EP | 1703491 | A1 | 9/2006 |
| EP | 1579422 | B1 | 10/2006 |
| EP | 1899956 | B1 | 10/2009 |
| EP | 1244093 | B1 | 10/2010 |
| JP | 2006289775 | A | 10/2006 |
| WO | 0201438 | A2 | 1/2002 |
| WO | 0201439 | A2 | 1/2002 |
| WO | 0229610 | A2 | 4/2002 |
| WO | 02063599 | A1 | 8/2002 |
| WO | 02080530 | A2 | 10/2002 |
| WO | 2007029002 | A2 | 3/2007 |
| WO | 2010043258 | A1 | 4/2010 |

OTHER PUBLICATIONS

Wikipedia article on 44,100Hz, from Feb. 15, 2012.*

Feng, Yazhong, Yueting Zhuang, and Yunhe Pan. "Music information retrieval by detecting mood via computational media aesthetics." Web Intelligence, 2003. WI 2003. Proceedings. IEEE/WIC International Conference on. IEEE, 2003.*

* cited by examiner

| $A_2$ | $B_2\flat/A_2\#$ | $B_2$ | $C_3$ | $C_3\#/D_3\flat$ | $D_3$ | $E_3\flat/D_3\#$ | $E_3$ | $F_3$ | $F_3\#/G_3\flat$ | $G_3$ | $A_3\flat/G_3\#$ | L | M | H |
|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 |

| $A_3$ | $B_3\flat/A_3\#$ | $B_3$ | $C_4$ | $C_4\#/D_4\flat$ | $D_4$ | $E_4\flat/D_4\#$ | $E_4$ | $F_4$ | $F_4\#/G_4\flat$ | $G_4$ | $A_4\flat/G_4\#$ | L | M | H |
|---|---|---|---|---|---|---|---|---|---|---|---|---|---|---|
| 0 | 0 | 1 | 0 | 0 | 1 | 0 | 0 | 1 | 0 | 0 | 0 | 0 | 1 | 0 |

| $A_4$ | $B_4\flat/A_4\#$ | $B_4$ | $C_5$ | $C_5\#/D_5\flat$ | $D_5$ | $E_5\flat/D_5\#$ | $E_5$ | $F_5$ | $F_5\#/G_5\flat$ | $G_5$ | $A_5\flat/G_5\#$ | L | M | H |
|---|---|---|---|---|---|---|---|---|---|---|---|---|---|---|
| 1 | 0 | 0 | 0 | 0 | 0 | 0 | 0 | 0 | 0 | 0 | 0 | 0 | 1 | 0 |

| $A_5$ | $B_5\flat/A_5\#$ | $B_5$ | $C_6$ | $C_6\#/D_6\flat$ | $D_6$ | $E_6\flat/D_6\#$ | $E_6$ | $F_6$ | $F_6\#/G_6\flat$ | $G_6$ | $A_6\flat/G_6\#$ | L | M | H |
|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 |

FIGURE 3

ARTIFICIAL NEURAL NETWORK BASED SYSTEM FOR CLASSIFICATION OF THE EMOTIONAL CONTENT OF DIGITAL MUSIC

FIELD OF THE DISCLOSED SUBJECT MATTER

The present subject matter is directed to the classification and retrieval of digital music based on emotional content. In particular, the present disclosure is directed to the encoding of digital music in a form suitable for input into an artificial neural network, training of a neural network to identify the emotional content of digital music so encoded, and the retrieval of digital music corresponding to various emotional criteria.

BACKGROUND

Creators of multimedia presentations have long recognized the dramatic impact of well-chosen music in their artistic works. Filmmakers, for example, have included musical scores that create emotions that complement and enrich what the actors are conveying as spoken words and what the cameras are conveying as visual images projected onto a screen. Few people can remember films like "Star Wars," "The Godfather," "Jaws," or "Rocky" without reliving the emotions created by their musical scores. Musical scores date back to the very creation of the movie industry, when early silent films starring Charlie Chaplin primarily relied on musical accompaniments to convey the emotions and messages of different movies. Musical scores have also been used to enhance documentaries. American composer Richard Rodgers created 13 hours of original music for the 1952 television series "Victory at Sea."

Over 38 years later, filmmaker Ken Burns used period music (along with innovative camera zooms and pans) to make 150 year old black and white photographs spring to life in the PBS TV series "The Civil War." Films like "The Civil War" series have probably inspired millions of amateur filmmakers to add music to their own photographic slide shows over the past 20 years. Amateurs are able to do that because of easy-to-use software created during that period. For example, an amateur using Apple's IPhoto® software can create a slide show accompanied by songs selected from his or her ITunes® library with a few clicks of a mouse. Software that allows users to create videos for dissemination on Youtube®, Google+® or Facebook® presents opportunities for users to enhance those videos by adding musical selections.

With the advent of compact disc technology, the widespread development and use of the Internet, and the availability of personal MP3 players like the IPod® device, a new industry has developed to create voice recordings of textual content (both fiction and nonfiction), which are widely marketed today as "audio books." Some audio books use limited amounts of music for introductions and conclusions or as transitions between chapters. Most audio books, however, contain only the recorded voice of the reader.

Electronic devices like Amazon's Kindle® reader or Barnes & Noble's Nook® reader, which allow one to download the textual content of books directly to the device, are rapidly transforming the way books are distributed and marketed to the public and then read by individual consumers. In a press release dated Dec. 26, 2009, Amazon reported that its sales of electronic books on December 25 of that year surpassed its sales of physical books for the first day in its history. Four months later, Apple's first IPad® tablet was sold to the public. Among other things, the IPad® tablet provides an alternative to the Kindle® reader in the market for downloading physical books to consumers. Both the Kindle® reader and the IPad® tablet provide an electronic visual display for textual content contained in existing physical books in a more convenient and efficient manner for users. The IPad® tablet and more recent multimedia devices such as Amazon's Kindle Fire® and Barnes & Noble's Nook Tablet® allow users to download multimedia content including audio books having enhanced video and audio features.

Recognizing the value of adding music to these multimedia works, there is a need for users, such as non-musicians, to have access to pre-recorded segments of music which are appropriate to the emotional impact which the user is attempting to convey. On the one hand, there is a need for users to be able to automatically classify known musical works, either acquired or composed by the user, with a representation of the emotional content, e.g., "fear," "suspense," "calm," or "majesty." In this way, music can be catalogued, e.g., stored in a database, along with one or more emotional attributes for later access. On the other hand, there is a need for users to access catalogs of music, either acquired or composed by the user, in which the emotional content of the music has been identified for easy selection, e.g., for adding to a multi-media work.

Artificial neural networks were first proposed in the 1940s. An artificial neural network comprises a series of interconnected artificial neurons that process information using a connectionist approach. Artificial neural networks are generally adaptive, being trainable based on sample data to elicit desired behaviors. Various training methods are available, e.g., backpropagation. Artificial neural networks are generally applicable to pattern classification problems.

Artificial neural networks were first simulated on computational machines in the mid 1950s. In 1958, Rossenblatt introduced the perceptron, a feedforward artificial neural network capable of performing linear classification. Backpropagation was applied as a training method to neural networks beginning in the 1970s and 1980s. Both the perceptron and the backpropagation algorithm are now well known in the art.

Various general purpose artificial neural network software are available. These software packages allow the user to specify the operating parameters of the network, including the number of neurons and their arrangement. Once a network is created, the user may train these networks through the use of training data selected by the user. The training data, applied to the neural network with the desired output values, allows the neural network to be adapted to provide desired behavior. As an example, the "Rumelhart" program provided by Michael Dawson and Vanessa Yaremchuk of the University of Alberta allows the user to configure and train a multilayer perceptron.

Although artificial neural networks provide a general purpose pattern classification tool, such networks are only capable of producing useful output when the input data is encoded. Thus, there remains a need in the art for an efficient encoding of digital audio suitable for the application of a neural network. There also remains a need for a system and method for classification of digital audio based on emotional content.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the disclosed subject matter, as embodied and broadly described, the disclosed subject matter includes a method of encoding a digital audio file including samples having a first sample rate. The sample rate of the input file can be constant or variable, e.g., Constant Bitrate (CBR) and Variable Bitrate (VBR). The method includes dividing the digital audio file into slices, each slice including one or more samples. One or more frequencies of sound represented in each slice is determined. One or more amplitudes associated with each of the frequencies in each slice is determined. A musical note associated with each of the frequencies in each slice is determined. A representation of each slice is output, in which the representation includes a set of musical notes and associated amplitudes. In some embodiments, the representation is binary. In some embodiments, the representation is hexadecimal.

In some embodiments, outputting the digital representation of each slice includes outputting the digital representation having a fixed length. The digital representation can include a first series of bits and a second series of bits. The first series of bits can correspond to a set of predetermined musical notes. The second series of bits can correspond to a set of predetermined amplitude ranges.

In some embodiments, the set of predetermined musical notes includes a musical scale. In some embodiments, the set of predetermined musical notes are substantially consecutive. In some embodiments, the set of predetermined musical notes comprises a chromatic scale.

For example, the first portion may have a length of one bit for each of the notes in the predetermined set of notes. In some embodiments, each of the first series of bits is set, e.g., set "high" or set to 1, if its corresponding one of the set of predetermined musical note is present in the slice. In some embodiments, each of the first series of bits is not set, e.g, set "low" or set to 0, if its corresponding one of the set of predetermined musical notes is not present in the slice.

For example, the second portion may have a length of one bit for each of the amplitude ranges, e.g., three bits representing "low" volume, "medium" volume, and "high" volume, etc. In some embodiments, each of the second series of bits is set, e.g., set "high" or set to 1, if an amplitude within its associated amplitude range exists within the slice and is not set, e.g, set "low" or set to 0, if an amplitude within its associated amplitude range does not exist within the slice.

In some embodiments, the determining one or more frequencies of sound represented in each of the slices includes performing a Fourier Transform.

In some embodiments, the first sample rate is about 44.1 KHz. In some embodiments, the method further includes resampling the digital audio file from the first sample rate to a second sample rate. In some embodiments, the second sample rate is about 6 KHz.

In some embodiments, each of the slices comprises substantially the same number of samples. In some embodiments, the number of samples in a slice is about 750.

In some embodiments, the step of outputting a digital representation) is repeated for each of a plurality of sets of predetermined musical notes.

A method of classifying the emotional content of a digital audio file is also provided. The method includes providing an artificial neural network comprising an input layer and an output layer; encoding the digital audio file as a set of musical notes and associated amplitudes; providing at least a portion of the set of musical notes and associated amplitudes to the input layer of the artificial neural network; and obtaining from the output layer of the artificial neural network at least one output indicative of the presence or absence of a predetermined emotional characteristic.

In some embodiments, the artificial neural network is trained by the input of a plurality of sets of musical notes and associated amplitudes with predetermined emotional characteristics.

In some embodiments, encoding the digital audio file includes dividing the digital audio file into slices, each slice including one or more samples; determining one or more frequencies of sound represented in each of the slices; determining one or more amplitudes associated with each of the frequencies in each slice; determining a musical note associated with each of the frequencies in each slice; and outputting a digital representation of each slice, wherein the digital representation includes a set of musical notes and associated amplitudes.

In some embodiments, the output layer includes a plurality of outputs, each of which is indicative of the presence of an emotional characteristic.

In some embodiments, the output layer includes a plurality of outputs, each of which is indicative of a degree of similarity to a predetermined piece of music.

In some embodiments, the output layer includes a plurality of outputs, each of which is indicative of a degree of similarity to one of the plurality of series of musical notes and associated amplitudes with known emotional characteristics.

A non-transient computer readable medium is providing, including instructions for creating an artificial neural network including an input layer and an output layer; instructions for encoding a digital audio file as a series of musical notes and associated amplitudes; instructions for inputting the series of musical notes and associated amplitudes into the input layer of the artificial neural network; and instructions for obtaining at least one output from the output layer of the artificial neural network indicative of a predetermined emotional characteristic.

A system for classification of the emotional content of music is provided, including an encoding module operable to encode a digital audio file as a set of musical notes and associated amplitudes; store the set of musical notes and associated amplitudes in a machine readable medium; and provide the set of musical notes and associated amplitudes to the classification module. The system also includes a classification module operable to receive the set of musical notes and associated amplitudes from the encoding module or the machine readable medium; classify the set of musical notes and associated amplitudes as having at least one of a plurality of predetermined emotional characteristics; and provide output indicative of the classification.

In some embodiments, the system includes a training module operable to receive a plurality of training series of musical notes and associated amplitudes with known emotional characteristics; and modify the classification module to classify each of the training series of musical notes and associated amplitudes according to the known emotional characteristics.

In some embodiments, the system includes a persistence module operable to store the classification module in a computer readable medium; and load the classification module from the computer readable medium.

In some embodiments, the computer readable medium includes a database.

In some embodiments, the system includes a plurality of supplemental classification modules.

In some embodiments, the classification module includes an artificial neural network. In some embodiments, the artificial neural network includes a plurality of nodes, a plurality of connections between the nodes, and a weight associated with each of the connections, and the system further includes a persistence module operable to store each the weight associated with each of the connections in a computer readable medium; and load the weight associated with each of the connections from the computer readable medium.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

BRIEF DESCRIPTION OF THE DRAWINGS

FIG. 3 depicts an encoded time slice of digital music in accordance with the present disclosure.

DETAILED DESCRIPTION OF EXEMPLARY EMBODIMENTS

Reference will now be made in detail to exemplary embodiments of the disclosed subject matter, examples of which are illustrated in the accompanying drawings. The method and corresponding steps of the disclosed subject matter will be described in conjunction with the detailed description of the system.

The disclosed subject matter is useful for encoding digital audio in an efficient manner that is both suitable for input to a neural network and preserves the features necessary for the neural network to perform classification based on emotional content. The disclosed subject matter is useful to structure and use a neural network to identify the emotional content of a digital audio file. In some embodiments, an input digital audio file includes a single piece of music or a portion thereof.

The term "Fourier analysis," as used herein, is a broad term and is used in its ordinary sense, including, without limitation, to refer to a Fourier transform, fast Fourier transform (FFT), discrete-time Fourier transform (DTFT), and Discrete Fourier transform (DFT).

The term "artificial neural network," as used herein, is a broad term and is used in its ordinary sense, including, without limitation, to refer to feedforward neural networks, single and multilayer perceptrons, and recurrent neural networks.

The methods and systems presented herein may be used for the classification of digital audio based on emotional content and the retrieval of digital audio meeting requested emotional characteristics. The disclosed subject matter is particularly suited for furnishing suitable music from a database of digital audio for use in as a music track in an audio book. For purposes of explanation and illustration, and not limitation, exemplary embodiments of the system in accordance with the disclosed subject matter are shown in FIGS. 1-4.

Figure 1:
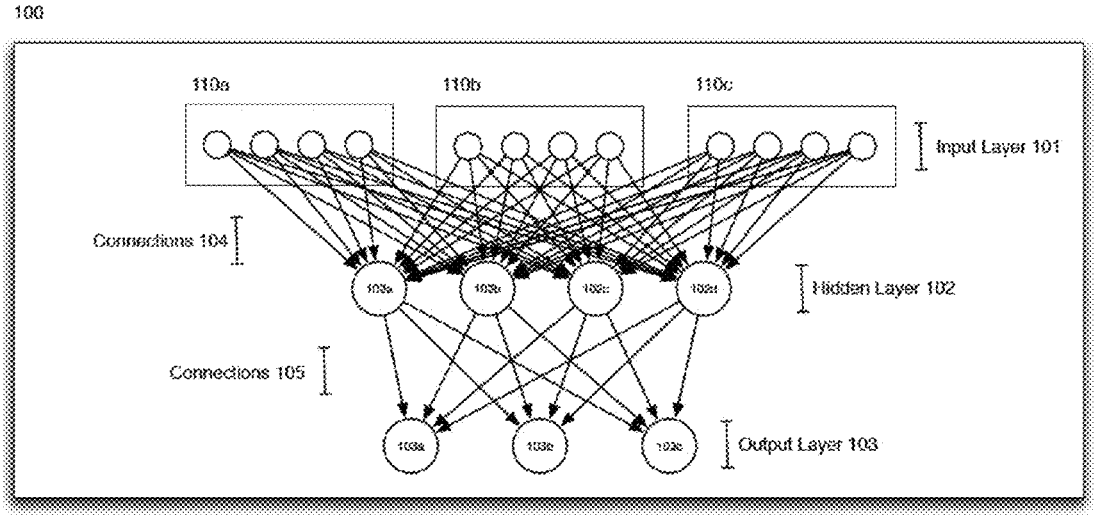
FIG. 1 depicts a neural network configured to process digital music in accordance with the present disclosure.

As shown in FIG. 1, the neural network 100 of the present disclosure generally includes sets of input nodes, e.g., 110*a*-110*c*, in an input layer 101. For illustrative purposes, three sets of input nodes are depicted. However, it is understood that the present subject matter may be practiced with one or more set of input nodes. Similarly, for illustrative purposes, four input nodes are depicted in each set. In one embodiment, there are 60 input nodes in each set. The present subject matter can be practiced with two or more input nodes in each set. In operation, each node 101*a*-101*b* of the input layer 101 is supplied with an input numeric value, usually a binary or hexadecimal value, or the like.

Connections 104 are provided from the input layer 101 to the hidden layer 102, e.g., from each node in the input layer 101 to each node in the hidden layer 102. Hidden layer 102 includes nodes 102*a*-102*d*. For illustrative purposes, four nodes are depicted in the hidden layer 102. However, the present subject matter can be practiced with one or more nodes in the hidden layer 102.

Each node of the input layer 101 transmits its input value over each of its outgoing connections 104 to the nodes of the hidden layer 102. Each of connections 104 has an associated weight. The weight value of each of connections 104 is applied to the input value, usually by multiplication of the weight with the input. Each node 102*a*-102*d* of the hidden layer 102 applies a function to the incoming weighted values. In some embodiments, a sigmoid function is applied to the sum of the weighted values, although other functions are known in the art.

Connections 105 are provided from the hidden layer 102 to the output layer 103, e.g., from each node of the hidden layer 102 to each node of the output layer 103. For illustrative purposes, the output layer 103 is depicted with three output nodes 103*a*-103*c*; however the present disclosure can be practiced with one or more output nodes in the output layer 103.

The results of the function applied by each node of hidden layer 102 are transmitted along connection 105 to each node of the output layer 103. Each of connections 105 has an associated weight. The weight value of each of connections 105 is applied to the value, usually by multiplication of the weight with the value. Each node of the output layer 103 receives these weighted values, which include the output of the neural network 100.

Specifically, and in accordance with the disclosed subject matter, in one embodiment, each of the sets of input nodes 110*a*-110*c* correspond to consecutive slices of input music. Each of the sets of input nodes 110*a*-110*c* include 60 nodes, each of which in turn correspond to one bit of the 60-bit encoding set forth herein and depicted in FIG. 3. The input to the neural network 100 is therefore a set of encoded slices of a source piece of music.

In one embodiment, each of the output nodes of output layer 103 corresponds to an individual emotion selected from the emotions provided for herein. The output values range from 0 to 1, a value of 1 indicating the strong presence of an emotion, 0 indicating the absence of an emotion, and intermediate values indicating a moderate presence of an emotion. In another embodiment, each of the output nodes of output layer 103 corresponds to a predetermined piece of music with known emotional content. In this embodiment, the output values range from 0 to 1, indicating the degree of similarity between the emotional content of the predetermined piece of music and the input piece of music. One of skill in the art would recognize that a different range of values could be selected while still achieving the results of the present disclosure.

The neural network 100 can be trained according to methods known in the art to determine the weights associated with connections 104 and 105. In a training process, input music with known emotional content is provided to the input layer 101 of neural network 100. The output from output layer 103 is compared to the known emotional attributes of the input music. If the output of output layer 103 does not indicate the expected emotional content, a correction is calculated and applied to the parameters of the neural network 100. As an example, if the output indicated a value of 1 for "uplifting" and 0 for "sad" when a sad song was provided to the neural network, a correction would be determined so that the next time the sad song was provided as input, the output would more accurately reflect its emotional content. In one embodiment, backpropagation as known in the art is used to train neural network 100, and corrections are applied to the weights associated with connection 104 and 105. However, one of skill in the art would recognize that various other training methods known in the art could be substituted while still achieving the results of the present disclosure.

To train the neural network 100, a corpus of music with known emotional content is provided to the neural network 100, and corrections are repeatedly applied to the neural network. The result is an incremental improvement in the accuracy of the neural network 100 when determining emotional characteristics. Once training is complete, the attributes of the neural network 100 are saved to persistent storage for later retrieval. In this way, a neural network according to the present disclosure can be reused without repeated retraining.

In one embodiment, the attributes of a plurality of neural networks are stored in a database. The stored neural networks may provide different emotional outputs. For example, a first neural network might provide output identifying "creepy" and "cute" while a second neural network might provide output identifying "comedy" and "beauty". As noted with regard to output layer 103 above, different neural networks corresponding to the present disclosure may have different numbers of output nodes in output layer 103, which correspond to different sets of emotions.

As shown in FIG. 3, an exemplary embodiment of an encoding scheme suitable for input to the input layer 101 of neural network 100 is provided. A binary scheme is described herein, although it is understood that a digital encoding scheme according to any appropriate numerical system, e.g., hexadecimal, may be used. The encoding of FIG. 3 is 60 bits long. (It is understood that the term "bit" is interchangeable with the appropriate numerical representation, such as digit, nibble, etc.) The 60 bit encoding includes 4 segments. Each segment includes two portions. The first portion includes 12 bits, corresponding to musical notes. The second portion includes three bits, corresponding to loudness. In one embodiment, depicted in FIG. 3, the notes are consecutive notes in a scale beginning with A. The first segment begins with A2, the second with A3, the third with A4, and the fifth with A5. The three loudness bits in each segment correspond to an amplitude range, e.g., Low (L), Medium (M), and High (H). As discussed above with regard to neural network 100, in one embodiment, each set of input nodes 110*a*-110*c* includes one 60 bit encoding. Each encoding corresponds to a slice of input music.

Figure 5:
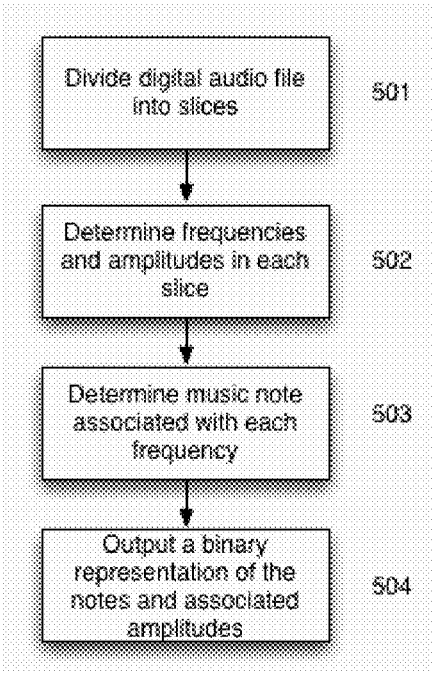
FIG. 5 depicts a technique of encoding a digital audio file in accordance with the present disclosure.

A conventional digital audio file may be encoded in the format depicted in FIG. 3 according to one embodiment of the invention. An exemplary technique for encoding a digital audio file is represented in FIG. 5. A conventional digital audio file is taken as input. Many formats of digital audio file are known in the art, each of which includes a plurality of samples at a sample rate. Each sample includes an amplitude of sound. The sample determines the frequency at which the amplitude of a sound is sampled. For reference, an audio CD is generally encoded at a rate of 44.1 kHz, as are various standard digital audio formats. According to one embodiment of the present disclosure, an input digital audio file is downsampled using techniques known in the art to a sample rate of 6 kHz. The input digital audio is divided into time slices (Step 501). In one embodiment of the invention, each time slice is approximately ⅛ of a second. At a sample rate of 6 kHz, a ⅛ second time slice includes 750 samples.

For each time slice one or more amplitudes is determined. The one or more amplitude samples is converted to one or more frequencies (Step 502). For example, Fourier analysis is used for conversion from a time domain representation to a frequency domain representation. In one embodiment, the Fourier analysis includes applying a Fourier transform to the amplitude encoding in order to determine frequency and amplitude pairs corresponding to the notes playing during the time slice. Once these frequencies have been determined, the musical notes corresponding to those frequencies are determined (Step 503). In one embodiment, notes below $A_2$ and above $G_4$# are discarded.

The digital representation as pictured in FIG. 3 is determined (Step 504). In some embodiments, the digital representation is based on the musical notes and associated amplitudes present in a time slice. Where a musical note a present, the corresponding bit is "set," e.g., set "high" or set to 1. Where a musical note is not present, the corresponding bit is not "set," e.g., set "low" or set to 0. FIG. 3 provides an example of an encoding of a time slice in which $B_3$, $D_4$, $F_4$, and $A_4$ are playing. The digital encoding of FIG. 3 additionally includes three bits corresponding to loudness for each octave. In the example of FIG. 3, there are no notes in the $A_2$-$G_3$# octave, and all of the loudness bits are set to 0. Both the $A_3$-$G_4$# and $A_4$-$G_5$# octaves have notes of medium loudness, so the Medium (M) bits are set to 1.

Figure 4:
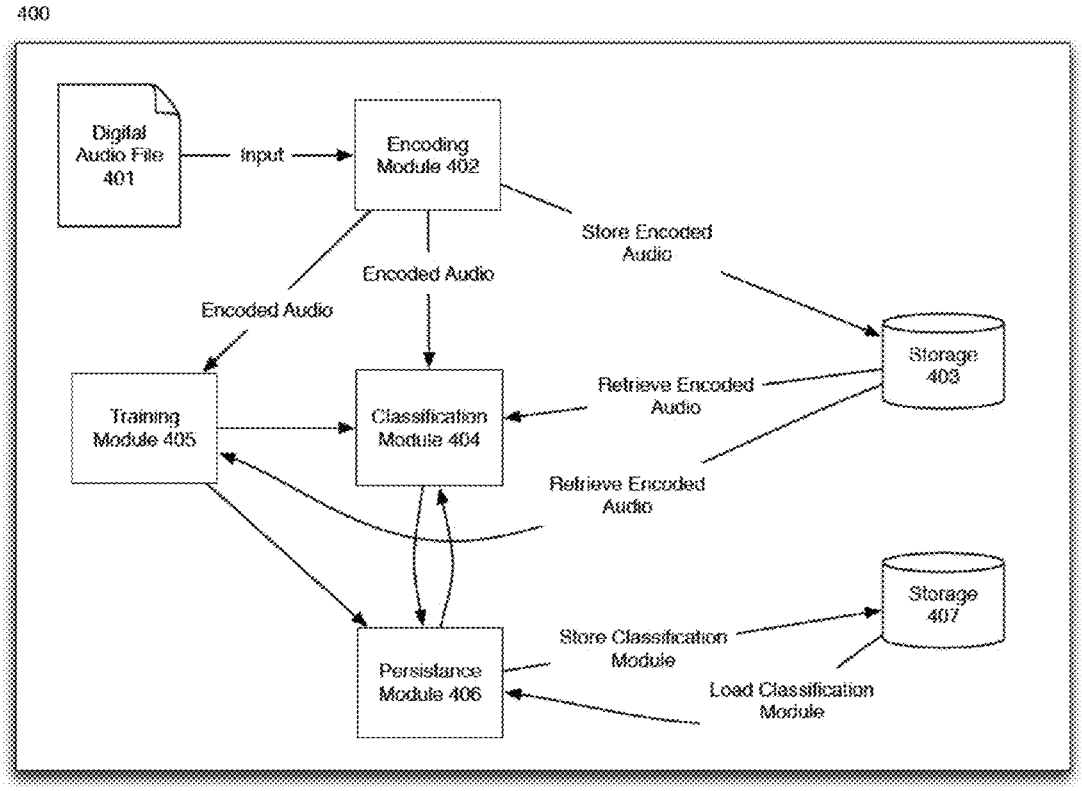
FIG. 4 depicts a system capable of classifying digital music in accordance with the present disclosure.

FIG. 4 depicts a system according to one embodiment of the disclosed subject matter. Each of the modules depicted on FIG. 4 operate on a computer, and include computer readable instructions, which may be encoded on a non-transient machine readable medium. In FIG. 4, a digital audio file 401 is provided to an encoding module 402. The encoding module encodes the input audio and sends the encoded audio either to storage or to a Classification Module 404. In one embodiment, the Encoding Module 402 provides encoded audio according to FIG. 3. In one embodiment, the Encoding Module 402 outputs a plurality of encoded time slices, each conforming to the encoding of FIG. 3.

The classification module 404 takes an encoded audio file as input, and determines its emotional attributes. In one embodiment, the classification module 404 includes neural network 100. The classification module may receive encoded audio directly from the encoding module 402 or by way of storage 403. The training module 405 trains the classification module 404 using encoded audio received either directly from encoding module 402 or from storage 403. In one embodiment, the training module performs training of a neural network as described above. In some embodiments, the training module directly modifies the classification module as training data is presented to it. In some embodiments, the training module determines the weights associated with connections 104 and 105 based on an entire set of training data and then provides these weights to the classification module. In some embodiments, weights determined by the training module are provided to persistence module 406 for storage in storage 407 and later retrieval from storage 407.

Persistence module 406 takes the parameters of classification module 404 and stores them in storage 407. Persistence module 406 may also retrieve the parameters of classification module 404 in order to recreate the classification module. In one embodiment, the persistence module stores and loads the weights of a neural network in accordance with the description set forth above. In one embodiment, persistence module 406 receives a set of weights from training module 405, stores them in Storage 407, and provides them to Classification Module 404.

Emotional Information and Database

Once the emotional characteristics of a piece of music are determined by the system of the present disclosure, those emotional characteristics are stored in a database and associated with other information regarding that piece of music. This metadata may include information about the original digital audio file itself, such as location, duration, and format. This metadata may also include information about the piece of music itself, such as composer, performers and date. The database may then be queried using methods known in the art to retrieve music with given characteristics. The query may be initiated to retrieve music suitable for use as a music track of an audio book.

Emotional attributes output by the neural network of the present disclosure, and stored in the database may include:

| |
|---|
| Accepting |
| Action |
| Adorable |
| Angelic |
| Anger |
| Bass |
| Beautiful |
| Beauty |
| Bittersweet |
| Calming |
| Cerebral |
| Cold |
| Comedic |
| Comedy |
| Contemporary |
| Cool |
| Creepy |
| Curious |
| Cute |
| Dangerous |
| Dark |
| Deadly |
| Dedication |
| Defeat |
| Difficult |
| Disbelief |
| Dramatic |
| Dropping |
| Easy |
| Emotion |
| Emotional |
| Empowerment |
| Energy |
| Epic |
| Fear |
| Frantic |
| Fun |
| Funny |
| Gentle |
| Goofy |
| Happy |
| Heart |
| Heartfelt |
| Heavy |
| Helpless |
| Hip |
| Hope |
| Hopeful |

-continued

| |
|---|
| Horror |
| Hurt |
| Innocent |
| Inspiration |
| Inspirational |
| Intentions |
| Light |
| Loving |
| Magic |
| Magical |
| Marimba |
| Mysterious |
| Mystery |
| Mystical |
| Nervous |
| Ominous |
| Organic |
| Passion |
| Peaceful |
| Pensive |
| Positive |
| Pretty |
| Quirky |
| Raging |
| Realization |
| Regret |
| Resolve |
| Romance |
| Romantic |
| Sad |
| Scary |
| Serious |
| Shifty |
| Silly |
| Soaring |
| Solemn |
| Sorrow |
| Sunny |
| Suspense |
| Suspenseful |
| Thoughtful |
| Tragedy |
| Transitional |
| Triumphant |
| Troublesome |
| Uncomfortable |
| Understanding |
| Upbeat |
| Uplifting |
| Violent |
| Wild |
| Wondering |
| Wonderment |
| Worrisome |
| Young |
| Zany |

Artificial Neural Network

The advantage of an artificial neural network is its ability through training "learn" to "recognize" patterns in the input and classify data objects (in this case, pre-recorded segments of music). Not only does this approach reduce the labor involved in manually categorizing pre-recorded segments of music, it also (1) ensures consistency and (2) ensures greater speed in retrieving the desired segments.

One neural network implementation that may be used to practice the subject matter of the present disclosure is the "Rumelhart" program. This program may be configured to provide a two or three layer neural network. The "Rumelhart" program may be configured to provide a three layer network in accordance with the present disclosure, including an input layer, a hidden layer and an output layer. In one embodiment of the present disclosure, the neural network is configured to have an integer multiple of 60 input neurons, each set of 60 corresponding to a single time slice. In one embodiment, the neural network is configured to have two output neurons corresponding to two distinct segments of music. Each set of 60 input nodes correspond to a single time slice of ⅛ second.

The number of nodes in the hidden layer may be varied. Increasing the number of hidden neurons tends to facilitate training of the network and allows the network to "generalize", but decreases the ability of the network to discriminate between different types of patterns.

Arbitrary weights are initially assigned to each of the connections from the input and output neurons to the hidden layer. The network is "trained" using a series of input patterns of 60 binary digits each. The input neuron values are multiplied by the connection weights and summed up across all paths leading into each hidden neuron to get new hidden neuron values. Similarly, the output neuron values are determined by multiplying the hidden neuron values by the connection weights and summing up across all paths leading into each output neuron from each hidden neuron. The value for each output neuron thus obtained is then compared to the correct output value for that pattern to determine the error. The error is then "propagated backwards" through the network to adjust the weights on the connections to obtain a better result on the next pass. This process is then repeated again for each pattern multiple times until there is no error or a time limit is reached. The quality of the training is determined at any point in time by the number of "hits"; that is, the number of patterns with correct output on a given pass through the training patterns.

After the network is trained, the weights on the connections can be retained and new or old patterns can be presented to the network to see if the network "recognizes" the patterns. For example, if the user wants to see if the network can recognize that a new piece of music is similar to one it has been trained on, the user can process the new music and feed the resulting binary patterns to the network for one pass through the patterns while keeping the trained connection weights constant. The percentage of hits on a single pass determines how close the match is between the new and old music.

Encoding

Music is transmitted to the ear by pressure waves that vary in amplitude with time. These waves are generated at the instruments by the vibration of strings (e.g., pianos, violins, harps, guitars, etc.) or membranes (e.g., drums), or the generation of standing sound waves (e.g., trumpets, tubas, trombones, etc.). The instruments generate the sound waves by pushing or pulling the surrounding air and generating regions of varying pressure. The frequency at which these waves vibrate generates tones or musical notes. Modern encoding schemes used for digitally encoding music usually consist of sampling the amplitude or volume of the music at a very high rate, typically 44,100 hertz (or times per second) and reducing each sample to a binary code that represents the amplitude of the sound at that point in time. Each sample is then recorded in a sequential time series in some media (e.g., CD, DVD, etc.).

Encoding input audio includes identification of the frequencies of the musical tones. To accomplish this, a Fourier transform may be used. The Fourier Transform converts the amplitude encoding of the music at any point in time into a distribution of frequencies by amplitude. In an exemplary embodiment, these frequencies are then converted into musical notes with the following formula:

$$\text{Note} = \frac{\log\frac{8f-8}{207.65}}{0.0578} + 12 \quad [1]$$

Figure 2:
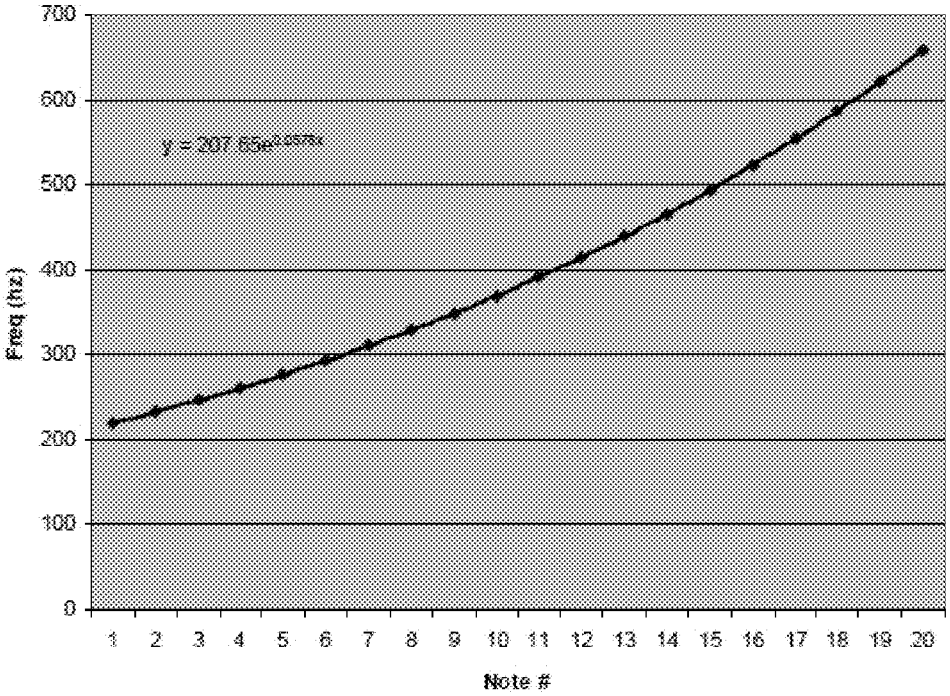
FIG. 2 depicts the frequencies of musical notes from A3 (220 hertz) to D#5 (622.25 hertz).

This formula corresponds to the relationship depicted in FIG. 2, which shows the frequencies of musical notes from $A_3$ at 220 hertz to $D_5$# at 622.25 hertz. As shown, there is an exponential relationship between the frequency (f) and the note.

These notes are then divided among 4 octaves of 12 notes each according to the following formulae.

$$\text{Octave} = \left\lfloor \frac{\text{Note}}{12} \right\rfloor + 1 \quad [2]$$

$$\text{Note} = 12(\text{Octave} - 1) \quad [3]$$

In this embodiment, notes below 110 hertz or above 1661.22 hertz are ignored.

Representations of music inherently contain an enormous amount of information. A challenge in devising a suitable encoding of music is data reduction. In order to reduce the data sets to a manageable amount, these data must be reduced to a manageable size. First, after a reduction of the sampling from 44,100 hertz to 6,000 hertz, input music is still quite recognizable, and the change in the quality of the music is not that noticeable. Reduction of the sampling rate in this manner reduces the amount of data by more than a factor of seven. Second, notes below about 100 hertz or above about 10,000 hertz are outside of the most human hearing range. The binary encoding is therefore limited to four octaves, from 110 hertz to 1661.22 hertz. Even with this reduction, the encoding still captures most of the relevant information in the music.

WavePad® Sound Editor is a tool that is available to perform resampling in accordance with embodiments of the present disclosure. Various tools are available for performing a Fourier transform, including Mathematica® and the WavePad® Sound Editor. Both resampling and the Fourier transform may be implemented in hardware or software, using a variety of techniques known in the art.

The duration of the time slice of the present disclosure can relate to the reliability and accuracy of the presently disclosed system. For example, a one second time slice may too long for certain musical segments. Music can change significantly in one second and so many different notes would be superimposed on top of one another within that one second time slice. The more notes present in a given time slice, the less distinguishable the encoding of the present disclosure becomes. For example, the longer a time slice is, the more likely it is to be all ones. However, each halving of the interval in a time slice doubles the amount of data to cover a given length of music. In one embodiment, an interval of, e.g., ⅛ second, allows the encoding of the present disclosure to capture the melody and tempo of music in a time series without driving the amount of data to an unmanageable level. It is understood that other intervals, e.g., in connection with other encoding schemes, will yield satisfactory results.

The amplitude or the loudness of the music is an important element of information to provide in the encoding of the present invention. In some embodiments, an amplitude is encoded for every note. However, to have an amplitude for each note can require a significant amount of data. In music samples with ⅛ second durations, notes in the same time slice are frequently at the same amplitude. The sensitivity of the ear to the amplitude of sound is a logarithmic function, meaning that the ear is not sensitive to small changes in the magnitude of sound. Consequently, in some embodiments, an encoding represents the amplitude of the input sound with three levels for each ⅛ second time slice. This technique would use three bits in the binary encoding for each time slice. All three levels could be present in the same slice, but the encoding would not include an indication of the level for each note.

In some embodiments, due to the sensitivity of the human ear and the range of octaves typically found in music, four octaves are used to capture the essence of a piece of music. Four octaves with twelve notes each is enough to include the interplay of the notes at each octave and capture the melody. Each octave is represented as a distinct element with the twelve notes in each octave represented by a single bit for each note, set to one if the note is present and 0 if the note is not present. Each octave has three magnitude bits at the end. This quadruples the size of the dataset, but substantially increases the fidelity of the binary representation. This results in a 60 bit binary representation for a single time slice: twelve note bits and three magnitude bits at each octave, times four octaves.

Presenting a sequence of single ⅛ second time slices to the neural network does not preserve the order of the sequence and may even randomize the sequence to avoid a bias during training. Consequently, there would be no dynamic in the music presented to the network. This means that the network really has no "knowledge" of the melody or tempo of the music. Melody and tempo are important elements of information in any music. So, the neural network is provided a set of time slices at the same time in each input pattern. This improves the ability of the network to recognize and discriminate different pieces of music. Increasing the number of time slices in each input pattern significantly increases the number of input nodes. The total number of input nodes is equal to 60 times the number of time slices presented in a single pattern. Thus, the relatively small size of the encoding allows more time slices to be considered by the neural network at a time without increasing the size of the input layer to an unmanageable size.

Comparisons

The system of the present disclosure may be used to compare the emotional content of several pieces of music in order to identify similarities in emotional content. This may be done using a pair-wise comparison or a multiple comparison.

Pair-wise comparison involves training the neural network using two pieces of music and then comparing a new piece of music with one of those two pieces of music. In this comparison two assumptions are made: If the two compared pieces of music are similar, the attributes describing the two pieces of music are similar. If they are different, the attributes describing the two pieces of music are different. The first assumption is clearly true in the limiting case where we compare two pieces of music that are identical. If the neural network trains properly, the number of matches when comparing a piece of music with itself will almost certainly approach 100%. The number of matches then becomes a surrogate for the degree of similarity between two pieces of music.

In some embodiments, a plurality of neural networks trained for pair-wise comparison are arranged in a decision tree in order to classify a new piece of music based on its emotional content. This allows multiple smaller neural networks according to the present disclosure to be stored and used for classification instead of providing a smaller number of large neural networks that provide a large number of outputs corresponding to every emotional characteristic. Pair-wise comparison uses a known universe of examples subject to human evaluation, but as the database of neural networks matured, the process will become more and more automated.

Multiple comparisons involve training the network on many pieces of music and then comparing a single new piece of music with each of the pieces the network has been trained on. The advantage of the pair-wise approach is the network trains very quickly and accurately. The disadvantage is with a network trained on two samples, new music is frequently outside the domain of training of the network and much of the power of the network to recognize patterns is lost. The disadvantage of the multiple comparisons approach is it takes much longer to train the network and the accuracy of the training is not as high, but the advantage is a new piece of music can be compared to multiple pieces at one time and the network training of any single network covers a much richer domain. It would still be necessary to have many trained networks to capture all the information contained in a complete library, but the number would be reduced by a factor of the number of samples contained in each network.

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

I claim:

1. A method of encoding a digital audio file comprising samples having a first sample rate, said method comprising:

a) dividing said digital audio file into slices, each slice comprising one or more samples;

b) determining one or more frequencies of sound represented in each of said slices;

c) determining one or more amplitudes associated with each of said frequencies in each slice;

d) determining a musical note associated with each of said frequencies in each slice; and e) outputting a digital representation of each slice, wherein the digital representation comprises a set of musical notes and associated amplitudes, and wherein the outputting the digital representation of each slice comprises outputting the digital representation having a fixed length and comprising a first and a second series of bits, the first series of bits corresponding to a set of predetermined musical notes, and the second series of bits corresponding to predetermined amplitude ranges.

2. The method of claim 1 wherein the set of predetermined musical notes comprise a musical scale.

3. The method of claim 1 wherein the set of predetermined musical notes are substantially consecutive.

4. The method of claim 1 wherein the set of predetermined musical notes comprises a chromatic scale.

5. The method of claim 1, wherein the digital representation is hexadecimal.

6. The method of claim 1, wherein the digital representation is binary.

7. The method of claim 6, wherein each of said first series of bits is set if its corresponding one of the set of predetermined musical note is present in the slice, and is not set if its corresponding one of the set of predetermined musical notes is not present in the slice.

8. The method of claim 1, wherein each of said second series of bits is set if an amplitude within its associated amplitude range exists within the slice and is not set if an amplitude within its associated amplitude range does not exist within the slice.

9. The method of claim 1 wherein said determining one or more frequencies of sound represented in each of said slices comprises performing a Fourier Transform.

10. The method of claim 1 wherein said first sample rate is about 44.1 KHz.

11. The method of claim 1 further comprising resampling said digital audio file from said first sample rate to a second sample rate.

12. The method of claim 11 wherein said second sample rate is about 6 KHz.

13. The method of claim 1 wherein each of said slices comprises substantially the same number of samples.

14. The method of claim 13 wherein the number of samples in a slice is about 750.

15. The method of claim 1 wherein step (e) is repeated for each of a plurality of sets of predetermined musical notes.

* * * * *